United States Patent [19]

Sakashita et al.

[11] Patent Number: 5,055,012

[45] Date of Patent: Oct. 8, 1991

[54] SCROLL COMPRESSOR WITH BYPASS RELEASE PASSAGE IN STATIONARY SCROLL MEMBER

[75] Inventors: Wataru Sakashita; Tsutomu Ichikawa, both of Shizuoka, Japan

[73] Assignee: Kabushiki Kaisha Toshiba, Kanagawa, Japan

[21] Appl. No.: 394,134

[22] Filed: Aug. 15, 1989

[30] Foreign Application Priority Data

Aug. 31, 1988 [JP] Japan ..... 63-216816
Sep. 2, 1988 [JP] Japan ..... 63-220225

[51] Int. Cl.[5] ..... F04B 49/02; F04C 18/04; F04C 29/08

[52] U.S. Cl. ..... 417/440; 418/55.1

[58] Field of Search ..... 418/15, 55 R, 181, 55.1; 417/304, 310, 440

[56] References Cited

U.S. PATENT DOCUMENTS 4,846,633 7/1989 Suzuki et al. ..... 417/310

FOREIGN PATENT DOCUMENTS 54-81513 6/1979 Japan .
57-16292 1/1982 Japan ..... 418/55 R
61-197783 9/1986 Japan ..... 418/55 R

*Primary Examiner*—John J. Vrablik
*Attorney, Agent, or Firm*—Philip M. Shaw, Jr.

[57] ABSTRACT

A scroll compressor for use in compressing gases includes a stationary scroll member having a top surface, a movable scroll member orbiting about the stationary scroll member for compressing gases together with the stationary scroll member as it orbits about the stationary scroll member, a discharge port formed in the center of the stationary scroll member for discharging the compressed gases, a plurality of release ports which are offset different distances from the center of the stationary scroll member, a release cavity formed in the stationary scroll member and in communication with one of the plurality release ports, a release guide passage passing through the stationary scroll member in parallel with the top surface of the stationary scroll member in communication with the release cavity, a sealed case for housing the stationary scroll member and the movable scroll member and a release pipe connected to the release guide passage through the sealed case.

7 Claims, 6 Drawing Sheets

SCROLL COMPRESSOR WITH BYPASS RELEASE PASSAGE IN STATIONARY SCROLL MEMBER

FIELD OF THE INVENTION

The present invention relates generally to a scroll compressor, and more particularly, to a scroll compressor with a gas releasing section.

BACKGROUND OF THE INVENTION

A scroll compressor has been widely used as a compressor means for compressing gas and increasing the gas pressure. This is because the scroll compressor is superior to reciprocal compressors and rotary compressors in many ways, e.g., low gas leakage, high compressing efficiency, small torque change, low vibration, low noise, etc.

For example, a conventional scroll compressor is constituted as shown in FIG. 1. In FIG. 1, the scroll compressor comprises a sealed case 11, a frame 12, a compressing unit 13 and a driving unit 14. The frame 12 divides the inside of the sealed case 11 into two spaces. The compressing unit 13 is mounted on the frame 12 at the upper space of the sealed case 11. The driving unit 14 is mounted on the frame 12 at the lower space of the sealed case 11. The driving unit 14 has a crank shaft 15 which rotatably penetrates the frame 12.

The compressing unit 13 comprises an orbiting scroll member 16 and a stationary scroll member 17. The orbiting scroll member 16 includes a disc-plate 18 and a spiral wrap 19 formed primarily in an involute curve and attached to one surface of the disc-plate 18 in an upstanding position. The stationary scroll member 17 includes a disc-plate 20 and a spiral wrap 21 formed primarily in an involute curve and attached to one surface of the disc-plate 20 in an upstanding position. The orbiting scroll member 16 and the stationary scroll member 17 are arranged in juxtaposed relation, with the spiral wrap 19 and the spiral wrap 21 thereof being fitted closely together. The orbiting scroll member 16 is moved in orbiting motion by an eccentric shaft portion 22 of the crank shaft 15 while the rotation of the orbiting scroll member 16 on its own axis is inhibited by an Oldham's ring 23 interposed between the orbiting scroll member 16 and the frame 12. The orbiting movement of the orbiting scroll member 16 reduces the compressing space 13*a* in compressing unit 13 found between the orbiting scroll member 16 and the stationary scroll member 17 and compresses a gas contained therein to increase its pressure.

The disc-plate 20 defines a discharge port 25 at its center O. The upper surface of the disc-plate 20 is covered with a muffler 26. Thus, the gas compressed by both the orbiting scroll member 16 and the stationary scroll member 17 are discharged into a muffler space 26*a* which is defined by the stationary scroll member 17 and the muffler 26. The muffler space 26*a* is connected to an outer facility through a discharge pipe 27. One end of the discharge pipe 27 extends into the muffler space 26*a* through the muffler 26. Another end of the discharge pipe 27 is connected to, e.g., a condenser (not shown) of the outer facility. Thus, the compressed gas is supplied to a condenser in the outer facility.

The gas is then fed back to the scroll compressor from the outer facility through a suction pipe 28. One end of the suction pipe 28 extends into the lower space of the sealed case 11 through the cylindrical wall of the sealed case 11. Another end of the suction pipe 28 is connected to, e.g., an accumulator (not shown) of the outer facility. The fedback gas is sucked in the compressing unit 13 through suction ports (not shown) defined in the disc-plate 18 at its peripheral portion. Thus, the gas is compressed during the orbiting movement of the orbiting scroll member 16.

The scroll compressor further comprises a release port 29 and a release pipe 30. The release port 29 and the release pipe 30 constitute a bypass system together with a control valve (not shown) provided in the outer facility. The release port 29 is defined in the disc-plate 20 at a position offset from the center O by a prescribed distance. One end of the release pipe 30 is coupled to the release port 29. Another end of the release pipe 30 extends outside the scroll compressor by penetrating both the muffler 26 and the sealed case 11 and communicates with the suction pipe 28 through the control valve.

In the scroll compressor, the pressure of the gas in the compressing unit 13 becomes high as the portions of the spiral wrap 19 and the spiral wrap 21 of the orbiting scroll member 16 and the stationary scroll member 17 in contact with each other approach the center O of each the stationary scroll member 17 and the disc-plate 18. This increase in pressure occurs periodically during the orbiting movement of the orbiting scroll member 16. The gas pressure of the supply gas output from the scroll compresser is determined primarily by the rotation speed of the orbiting scroll member 16. Thus, the gas pressure is generally controlled by changing the rotation speed of the orbiting scroll member 16 through the driving unit 14. However, the scroll compressor exhibits its maximum efficiency at a prescribed range of rotation speeds. Thus, the rotation speed should be kept within the range. The bypass system is used for reducing the gas pressure of the supply gas output from the scroll compresser while keeping the rotation speed in the desired range when the demands of the outer facility are lowered.

The conventional scroll compressor is constructed as above, and has some drawbacks, as described below. That is, the release pipe 30 penetrates both the muffler 26 and the sealed case 11, as described above. Further, the release pipe 30 is bent in the muffler space 26*a* for connecting to the release port 29. In the manufacturing of the actual products, it is very difficult to penetrate both the muffler 26 and the sealed case 11 and then bend the release pipe 30 in the muffler space 26*a*, or vice versa, without causing leaks. Thus, the conventional scroll compressor as shown in FIG. 1 is not practical for mass production.

SUMMARY OF THE INVENTION

It is, therefore, an object of the present invention to provide a scroll compressor with a gas releasing section which is easy to manufacture.

Another object of the present invention to provide a scroll compressor with a gas releasing section which is able to widely change its ability to release gas.

In order to achieve the above object, a scroll compressor with a gas releasing section according to one aspect of the present invention includes a stationary scroll member having a top surface, a movable scroll member orbiting about the stationary scroll member for compressing gases together with the stationary scroll member as it orbits about the stationary scroll member, a discharge port formed in the center of the stationary scroll member for discharging the compressed gases, a plurality of release ports which are offset different distances from the center of the stationary scroll member, a release cavity formed in the stationary scroll member and in communication with one of the plurality of release ports, a release guide passage passing through the stationary scroll member in parallel with the top surface of the stationary scroll member in communication with the release cavity, a sealed case for housing the stationary scroll member and the movable scroll member and a release pipe connected to the release guide passage through the sealed case.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
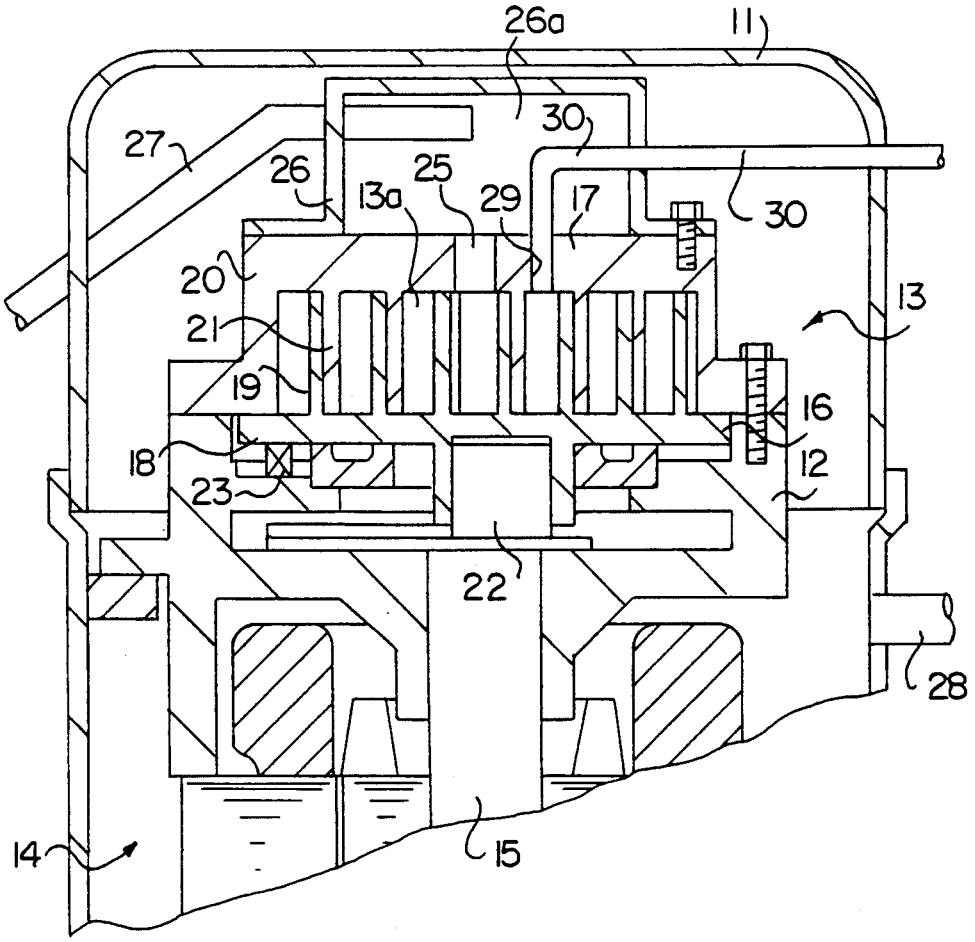
FIG. 1 PRIOR ART
FIG. 1 is a section showing a part of a conventional scroll compressor.

The present invention will be described in detail with reference to the FIGS. 2 through 8. Throughout the drawings, reference numerals or letters used in FIG. 1 will be used to designate like or equivalent elements for simplicity of explanation.

Figure 2:
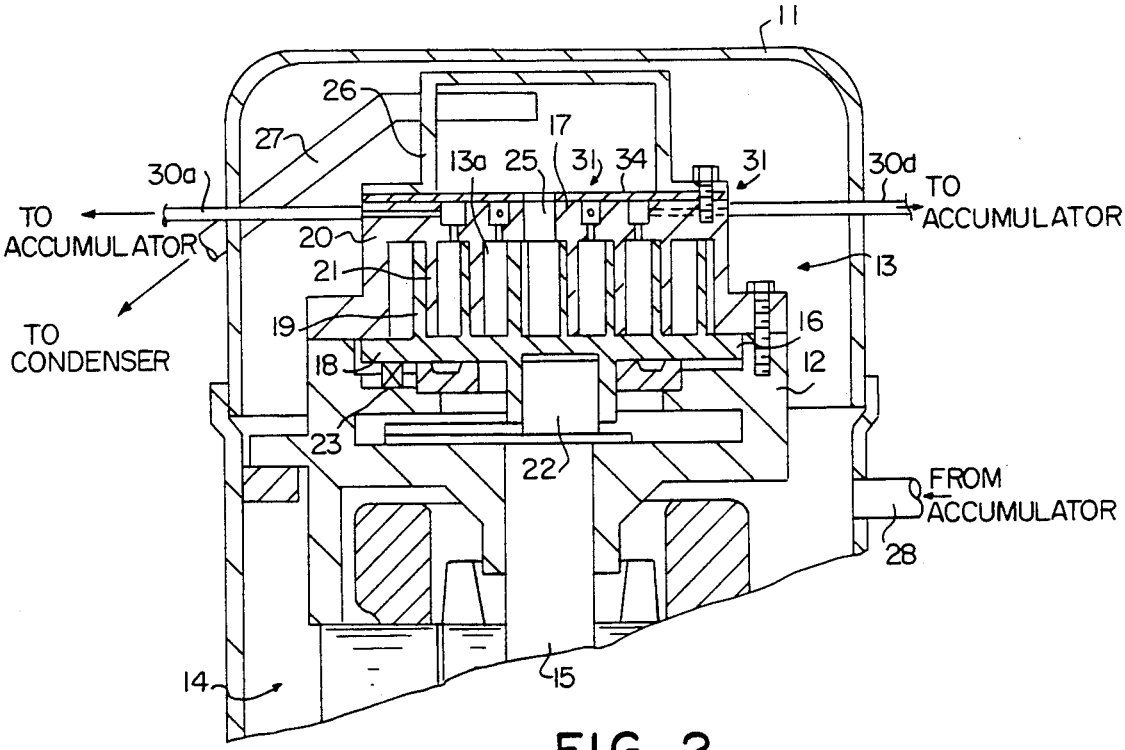
FIG. 2 is a section showing a part of a first embodiment of the scroll compressor according to the present invention.
Figure 3:
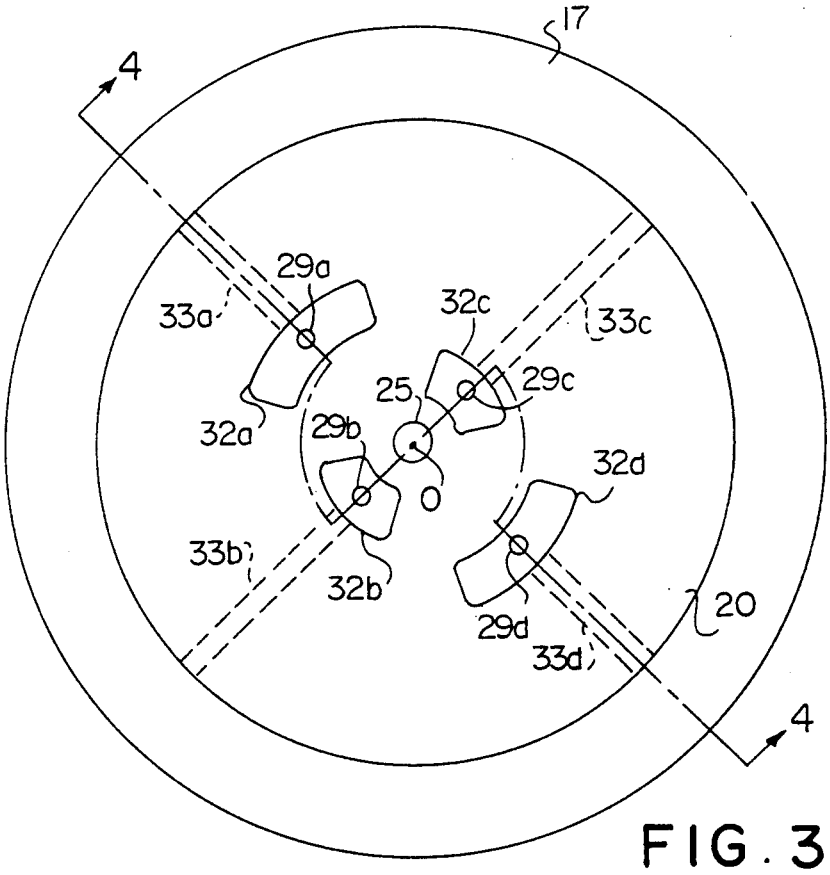
FIG. 3 is a plan showing the stationary scroll member of FIG. 2.
Figure 4:
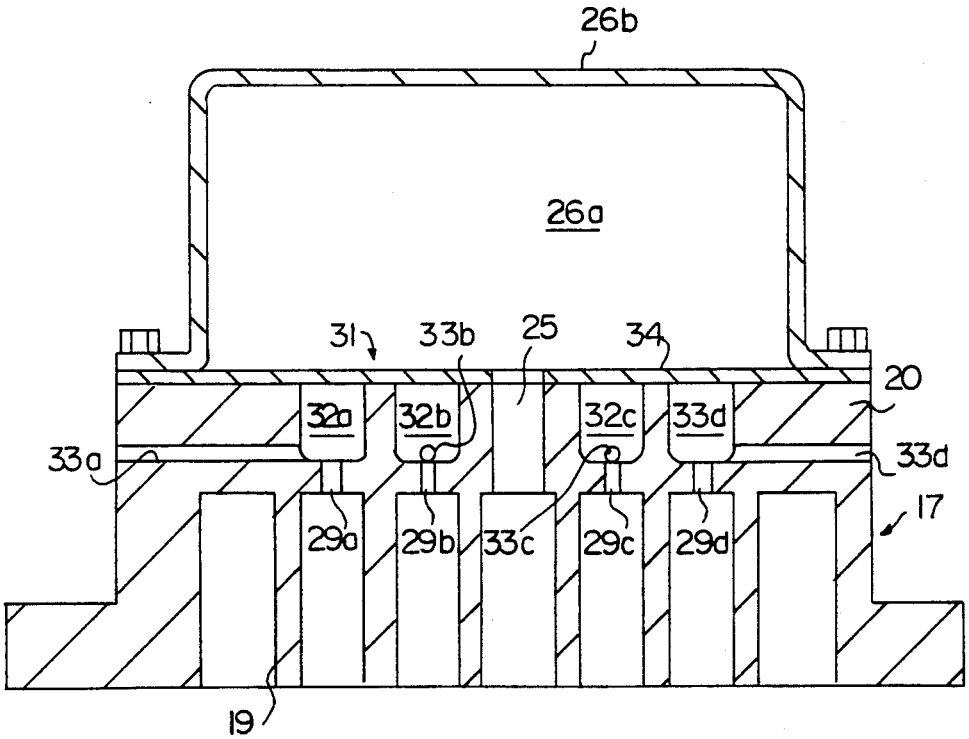
FIG. 4 is an enlarged section showing the stationary scroll member and the muffler taken along the line 4—4 in FIG. 3.

Referring now to FIGS. 2, 3 and 4, a first embodiment of the scroll compressor with a gas release section according to the present invention will be described in detail. In FIG. 2, the scroll compressor comprises a sealed case 11, a frame 12, a compressing unit 13 and a driving unit 14. The frame 12 divides the inside of the sealed case 11 into two spaces. The compressing unit 13 is mounted on the frame 12 at the upper space of the sealed case 11. The driving unit 14 is mounted on the frame 12 at the lower space of the sealed case 11. The driving unit 14 has a crank shaft 15 which rotatably penetrates the frame 12.

The compressing unit 13 comprises an orbiting scroll member 16 and a stationary scroll member 17. The orbiting scroll member 16 includes a disc-plate 18 and a spiral wrap 19 formed primarily in an involute curve and attached to one surface of the disc-plate 18 in an upstanding position. The stationary scroll member 17 includes a disc-plate 20 and a spiral wrap 21 formed primarily in an involute curve and attached to one surface of the disc-plate 20 in an upstanding position. The orbiting scroll member 16 and the stationary scroll member 17 are arranged in juxtaposed relation with the spiral wrap 19 and the spiral wrap 21 thereof being fitted closely together, and the orbiting scroll member 16 is moved in orbiting motion by an eccentric shaft portion 22 of the crank shaft 15 while the rotation of the orbiting scroll member 16 on its own axis is inhibited by an Oldham's ring 23 interposed between the orbiting scroll member 16 and the frame 12. The orbiting movement of the orbiting scroll member 16 reduces compressing unit **13*a* defined between the orbiting scroll member 16 and the stationary scroll member 17** and compresses a gas therein to increase its pressure.

The disc-plate 20 defines a discharge port 25 at its center O. The upper surface of the disc-plate 20 is covered with a muffler 26. Thus, the gas compressed by both the orbiting scroll member 16 and the stationary scroll member 17 are discharged in a muffler space **26*a* which is defined by the stationary scroll member 17 and the muffler 26. The muffler space 26*a* is connected to an outer facility through a discharge pipe 27. One end of the discharge pipe 27 extends into the muffler space 26*a* through the muffler 26. Another end of the discharge pipe 27** is connected to, e.g., a condenser (not shown) of the outer facility. Thus, the compressed gas is supplied to a condenser of the outer facility.

The gas is then fed back to the scroll compressor from the outer facility through a suction pipe 28. One end of the suction pipe 28 extends into the lower space of the sealed case 11 through the cylindrical wall of the sealed case 11. Another end of the suction pipe 28 is connected to, e.g., an accumulator (not shown) of the outer facility. The fedback gas is sucked in the compressing unit 13 through suction ports (not shown) defined in the disc-plate 18 at its peripheral portion. Thus, the gas is compressed during the orbiting movement of the orbiting scroll member 16.

The scroll compressor further comprises a release mechanism 31. The release mechanism 31 includes a plurality of release ports, e.g., four release ports **29*a*, 29*b*, 29*c* and 29*d*, a plurality of release cavities, e.g., four release cavities 32*a*, 32*b*, 32*c* and 32*d*, a plurality of release guide passages, e.g., four release guide passages 33*a*, 33*b*, 33*c* and 33*d*, a plurality of release pipes, e.g., four release pipes 30*a*, 30*b*, 30*c* and 30*d* and a cover plate 34 (see FIG. 3). The release mechanism 31** together with a control valve (not shown) constitutes a bypass system.

Referring now to FIGS. 3 and 4, the release mechanism 31 will be described in detail below. As shown in FIG. 3, the release ports **29*a*, 29*b*, 29*c* and 29*d* are defined in the disc-plate 20 at positions offset from the center O by prescribed distances, respectively. As shown in FIG. 4, one end of the release ports 29*a*, 29*b*, 29*c* and 29*d* faces the compressing unit 13*a* of the compressing unit 13. The release ports 29*a* and 29*d* correspond to each other in reference to the discharge port 25, i.e., the center O of the disc-plate 20. The release ports 29*a* and 29*d* are positioned at the same distance from the center O, but relatively far from the center O. The release ports 29*b* and 29*c* correspond to each other in reference to the center O of the disc-plate 20. The release ports 29*b* and 29*c* are positioned at the same distance from the center O, but relatively close to the center O. The release ports 29***a*, 29*b*, 29*c* and 29*d* are arranged in rectangular relation with each other, in relation to the center O.

The release cavities 32*a*, 32*b*, 32*c* and 32*d* are defined in the disc-plate 20 at positions the same as the release ports 29*a*, 29*b*, 29*c* and 29*d*. The release cavities 32*a*, 32*b*, 32*c* and 32*d* have larger diameters than the release ports 29*a*, 29*b*, 29*c* and 29*d*. Thus, the other ends of the release ports 29*a*, 29*b*, 29*c* and 29*d* face one end of the release cavities 32*a*, 32*b*, 32*c* and 32*d* as shown in FIG. 3, respectively. The other end of the release cavities 32*a*, 32*b*, 32*c* and 32*d* faces the upper surface of the disc-plate 20.

The release guide passages 33*a*, 33*b*, 33*c* and 33*d* are defined in the disc-plate 20 in parallel to the plane of the disc-plate 20. One end of the release guide passages 33*a*, 33*b*, 33*c* and 33*d* is connected to the walls of the release cavities 32*a*, 32*b*, 32*c* and 32*d* as shown in FIG. 3, respectively. The other ends of the release guide passages 33*a*, 33*b*, 33*c* and 33*d* face the cylindrical wall of the disc-plate 20. The release guide passages 33*a*, 33*b*, 33*c* and 33*d* are arranged in rectangular relation with each other, in relation to the center O of the disc-plate 20.

The cover plate 34 covers the upper surface of the disc-plate 20. Thus, the release cavities 32*a*, 32*b*, 32*c* and 32*d* are isolated from the muffler space 26*a* of the muffler 26. However, the cover plate 34 defines an opening corresponding to the discharge port 25. Thus, the cover plate 34 allows the discharge port 25 to communicate with the muffler space 26*a* of the muffler 26.

One end of the release pipes 30*a*, 30*b*, 30*c* and 30*d* is coupled to each of the release guide passages 33*a*, 33*b*, 33*c* and 33*d*. The other end of the release pipes 30*a*, 30*b*, 30*c* and 30*d* extends outside the scroll compressor by penetrating the cylindrical wall of the sealed case 11 and then communicates with the suction pipe 28.

According to the first embodiment of the scroll compressor, the release pipes 30*a*, 30*b*, 30*c* and 30*d* penetrate only the cylindrical wall of the sealed case 11. Further, the release pipes 30*a*, 30*b*, 30*c* and 30*d* are not bent inside the scroll compressor. Thus, the release mechanism 31 has a simple construction to manufacture the scroll compressor.

Referring now to FIGS. 5 through 8, a second embodiment of the scroll compressor with a gas release section according to the present invention will be described in detail. The second embodiment of the scroll compressor is constructed similar to the first embodiment, except for release mechanism 31*a* and a muffler 26*b*. Accordingly, the second embodiment of the scroll compressor will be described primarily with reference to the release mechanism 31*a* and the muffler 26*b*.

The release mechanism 31*a* of the scroll compressor includes a plurality of release ports, e.g., two release ports 29*e* and 29*f*, a release cavity 32*e*, a release guide passage 33*e*, a release pipe 30*e* and a cover plate 34*b*. The release mechanism 31*a* together with a control valve (not shown) provided in the outer facility constitutes a bypass system.

Figure 6:
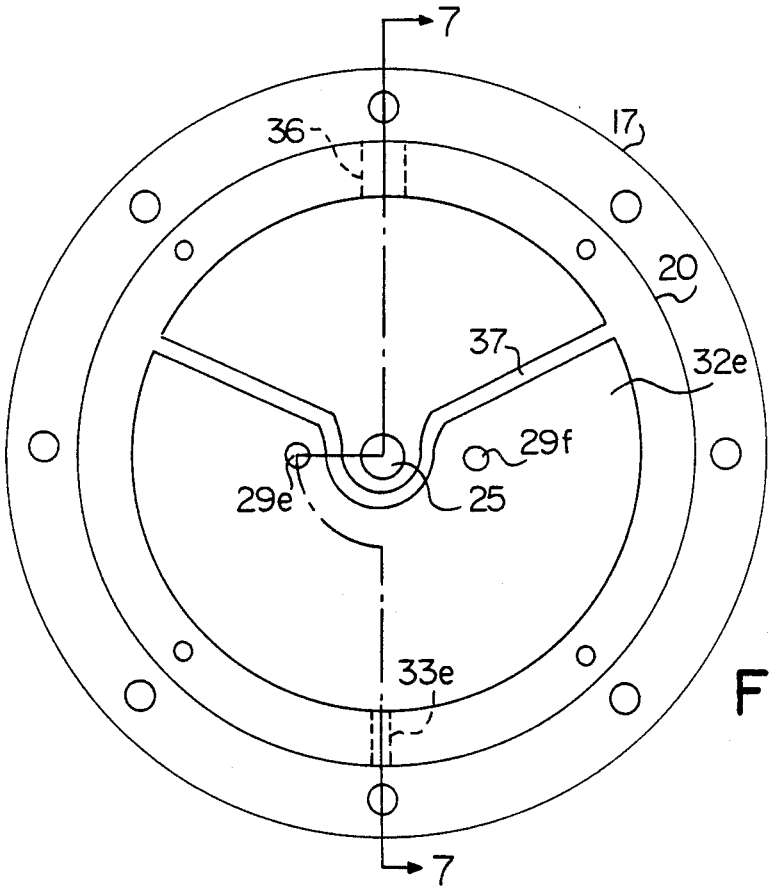
FIG. 6 is a plan showing the stationary scroll member of FIG. 5.
Figure 7:
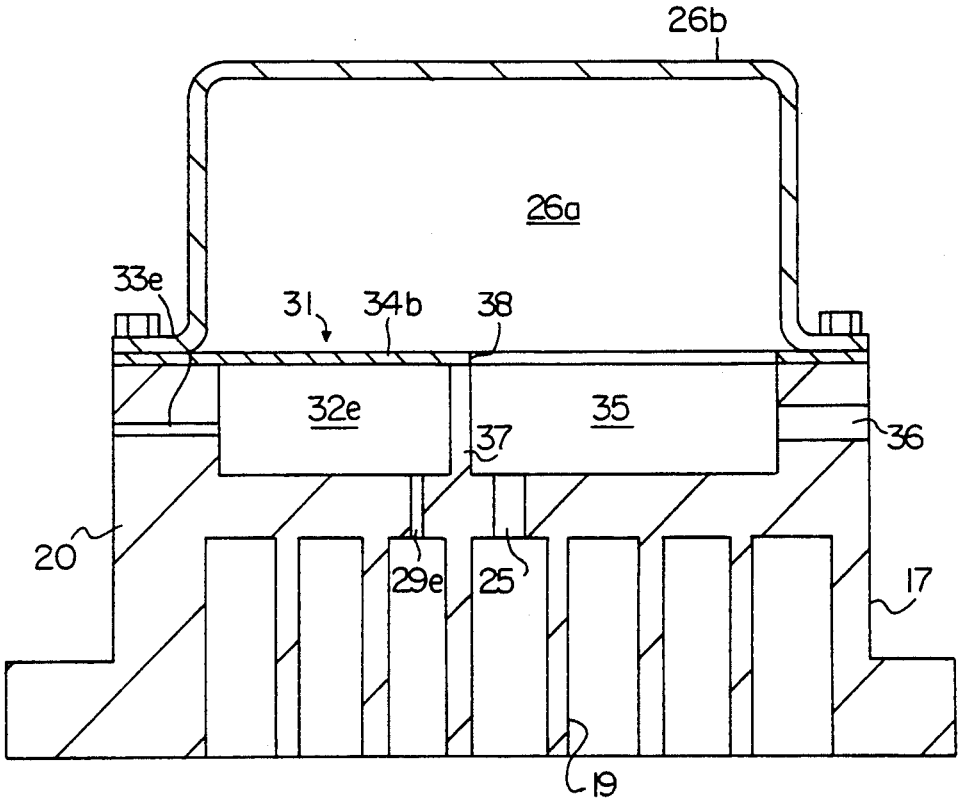
FIG. 7 is an enlarged section showing the stationary scroll member and the muffler taken along the line 7—7 in FIG. 6.

Referring now to FIGS. 6 and 7, the release mechanism 31*a* will be described in detail below. As shown in FIG. 6, the release ports 29*e* and 29*f* are defined in the disc-plate 20 at positions offset from the center O by prescribed distances as shown in FIG. 7, respectively. As shown in FIG. 7, one end of the release ports 29*e* and 29*f* faces the compressing unit 13*a* of the compressing space 13. The release ports 29*e* and 29*f* correspond to each other in reference to the discharge port 25, i.e., the center O of the disc-plate 20. The release ports 29*e* and 29*f* are positioned at the same distance from the center O.

The disc-plate 20 defines the release cavity 32*e* with a relatively large space volume so that the end of the release ports 29*e* and 29*f* faces the bottom of the release cavity 32*e* in common, as shown in FIG. 6. The upper end of the release cavity 32*e* faces the upper surface of the disc-plate 20.

The release guide passage 33*e* is defined in the disc-plate 20 in parallel to the plane of the disc-plate 20. One end of the release guide passage 33*e* faces the wall of the release cavity 32*e* as shown in FIG. 7. Another end of the release guide passage 33*e* faces the cylindrical wall of the disc-plate 20.

One end of the release pipe 30*e* is coupled to the release guide passage 33*e*. Another end of the release pipe 30*e* extends outside the scroll compressor by penetrating the cylindrical wall of the sealed case 11 and then communicates with the suction pipe 28.

Figure 5:
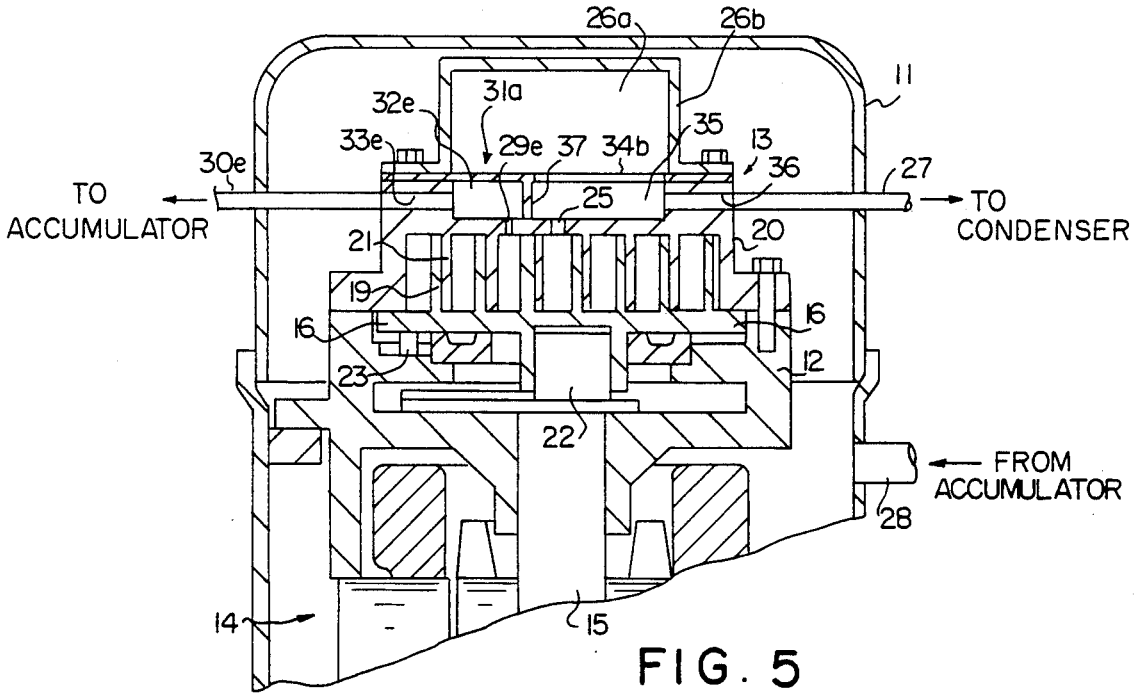
FIG. 5 is a section showing a part of a second embodiment of the scroll compressor according to the present invention.

The disc-plate 20 further defines a muffler cavity 35 and a discharge guide passage 36. The upper end of the discharge port 25 faces the bottom of the muffler cavity 35, as shown in FIG. 6. The upper end of the muffler cavity 35 faces the upper surface of the disc-plate 20. The muffler cavity 35 and the release cavity 32*e* are divided from each other by a partition wall 37. The discharge guide passage 36 extends in parallel to the plane of the disc-plate 20. One end of the discharge guide passage 36 faces the wall of the muffler cavity 35. Another end of the discharge guide passage 36 faces the cylindrical wall of the disc-plate 20. Then, one end of the discharge pipe 27 is connected to the discharge guide passage 36, as shown in FIG. 5. Another end of the discharge pipe 27 extends outside the scroll compressor through the cylindrical wall of the sealed case 11. The other end of the discharge pipe 27 is then connected with, e.g., a condenser (not shown) of the outer facility. Thus, the compressed gas is supplied to the condenser of the outer facility.

Figure 8:
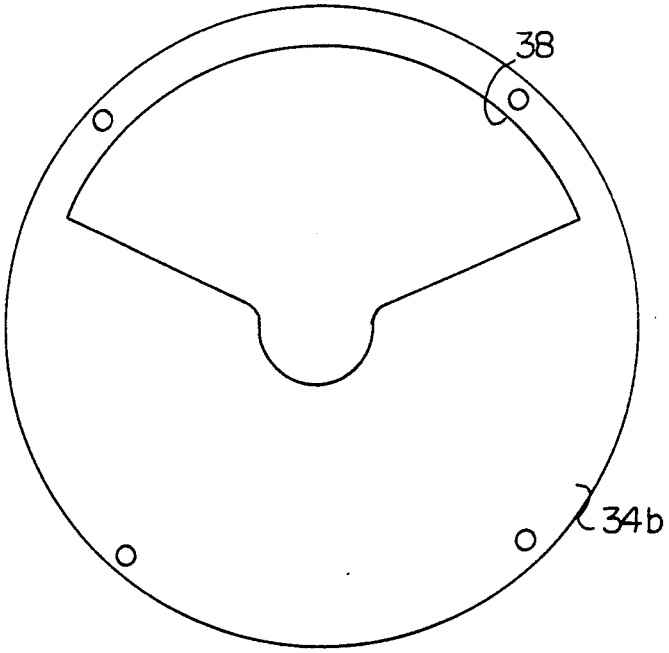
FIG. 8 is a plan showing the cover plate of FIGS. 5 and 7.

The cover plate 34*b* has an opening 38 which corresponds to the upper end of the muffler cavity 35 of the disc-plate 20, as shown in FIG. 8. The cover plate 34*b* is fixed on the disc-plate 20 so that the upper end of the release cavity 32*e* is closed by the cover plate 34*b*. However, the muffler cavity 35 communicates with the muffler space 26*a* of the muffler 26*b* through opening 38 of the cover plate 34*b*.

According to the second embodiment of the scroll compressor, the release pipe 30*e* penetrates only the cylindrical wall of the sealed case 11. Further, the release pipe 30*e* is not needed to be bent inside the scroll compressor. Thus, the release mechanism 31 has a simple construction which aids the manufacture of the scroll compressor. Further, the second embodiment has an expanded volume of the muffler cavity due to the muffler cavity 35. The muffler cavity 35 and the release cavity 32*e* can be formed by a similar process of manufacturing. Further, the discharge pipe 27 is not required to be bent inside the scroll compressor.

As described above, the present invention can provide an extremely preferable scroll compressor with a gas releasing section.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. A scroll compressor for use in compressing gases, comprising;

a stationary scroll member having a top surface;

a movable scroll member orbiting about the stationary scroll member for compressing gases together with the stationary scroll member as it orbits about the stationary scroll member;

a discharge port formed in the center of the stationary scroll member for discharging the compressed gases;

a plurality of release ports which are offset different distances from the center of the stationary scroll member;

a release cavity formed in the stationary scroll member and in communication with one of the plurality of release ports;

a release guide passage passing through the stationary scroll member in parallel with the top surface of the stationary scroll member in communication with the release cavity;

a sealed case for housing the stationary scroll member and the movable scroll member; and a release pipe connected to the release guide passage through the sealed case.

2. A scroll compressor as in claim 1, wherein the plurality of release ports further comprises a first pair of release ports and a second pair of release ports, in which the first pair of release ports is offset a different distance from the center of the stationary scroll member than the second pair of release ports, and the members of each pair are offset an equal distance from, and on opposite sides of, the center of the stationary scroll member.

3. A scroll compressor as in claim 2, further comprising four release ports, four release cavities and four release guide passages, located at 90° intervals around the discharge port, wherein two release ports located 180° apart are located a first distance from the discharge pipe and the remaining two release ports located 180° apart are located a second shorter distance from the discharge port.

4. A scroll compressor for use in compressing gases, comprising;

a stationary scroll member having a top surface divided into a first and second portion, with the first portion defining a muffler space;

a movable scroll member orbiting about the stationary scroll member for compressing gases together with the stationary scroll member as it orbits about the statinary scroll member;

a discharge port for discharging the compressed gases, formed in the center of the stationary scroll member and located within the first portion of the top surface of the stationary scroll member;

a plurality of release ports which are offset different distances from the center of the stationary scroll member;

a release cavity formed by the second portion of the top surface of the stationary scroll member, such that the second portion of the top surface includes one of the plurality of release ports;

a release guide passage passing through the stationary scroll member in parallel with the top surface of the stationary scroll member in communication with the release cavity;

a sealed case for housing the stationary scroll member and the movable scroll member; and a release pipe connected to the release guide passage through the sealed case.

5. A scroll compressor for use in compressing gases, comprising;

a stationary scroll member having a top surface;

a movable scroll member orbiting about the stationary scroll member for compressing gases together with the stationary scroll member as it orbits about the stationary scroll member;

a discharge port formed in the center of the stationary scroll member for discharging the compressed gases;

a plurality of release ports which are offset different distances from the center of the stationary scroll member;

a plurality of release cavities formed in the stationary scroll member, each release cavity being in communication with a release port;

a plurality of release guide passages passing through the stationary scroll member in parallel with the top surface of the stationary scroll member, each release guide passage being in communication with a release cavity;

a sealed case for housing the stationary scroll member and the movable scroll member; and a plurality of release pipes, each release pipe connected to a release guide passage through the sealed case.

6. A scroll compressor as in claim 5, wherein the plurality of release ports further comprises a first pair of release ports and a second pair of release ports, in which the first pair of release ports is offset a different distance from the center of the stationary scroll member than the second pair of release ports, and the members of each pair are offset an equal distance from, and on opposite sides of, the center of the stationary scroll member.

7. A scroll compressor as in claim 6, further comprising four release ports, four release cavities and four release guide passages, located at 90° intervals around the discharge port, wherein two release ports located 180° apart are located a first distance from the discharge pipe and the remaining two release ports located 180° apart are located a second shorter distance from the discharge port.

* * * * *